United States Patent [19]

Kenny

[11] Patent Number: 5,022,668

[45] Date of Patent: Jun. 11, 1991

[54] SKATEBOARD AXLE MOUNTING APPARATUS

[75] Inventor: Bradley T. Kenny, Box 1891, Mackenzie, B.C., Canada, V0J 2C0

[73] Assignee: Bradley Thomas Kenny, Mackenzie, Canada

[21] Appl. No.: 512,922

[22] Filed: Apr. 23, 1990

[51] Int. Cl.[5] ..... B62B 19/04

[52] U.S. Cl. ..... 280/7.14; 280/844; 280/11.28; 280/87.042; 301/111; 305/15

[58] Field of Search ..... 280/5.22, 7.1, 7.12, 280/7.14, 844, 11.27, 11.28, 87.042, 87.041; 180/9.21, 9.26, 9.3; 301/111, 114, 118, 120; 305/15

[56] References Cited

U.S. PATENT DOCUMENTS

| | | | |
|---|---|---|---|
| 4,116,455 | 9/1978 | Dotson et al. | 280/7.14 X |
| 4,138,128 | 2/1979 | Criss | 280/87.042 X |
| 4,161,323 | 7/1979 | Wetteland | 280/7.12 |
| 4,165,091 | 8/1979 | Chadwick | 280/87.042 X |
| 4,225,145 | 9/1980 | Carr | 280/7.14 |
| 4,244,593 | 1/1981 | Malone | 280/87.01 X |
| 4,337,961 | 7/1982 | Covert et al. | 280/844 |
| 4,521,029 | 6/1985 | Mayes | 280/7.14 |

FOREIGN PATENT DOCUMENTS

| | | | |
|---|---|---|---|
| 2405722 | 6/1979 | France | 280/7.12 |

*Primary Examiner*—Andres Kashnikow
*Assistant Examiner*—Michael Mar
*Attorney, Agent, or Firm*—Barrigar & Oyen

[57] ABSTRACT

A skateboard axle mounting apparatus having a base, a support element attached to the base for securely receiving a skateboard axle, and a mounting bracket for attaching the base to a friction-reducing accessory, such as a snow ski or a roller/belt assembly. The support element includes a guide located on the base and a pair of vertical end plates which slidably cooperate with the guide. Each end plate has a bore hole for securely receiving the skateboard axle. The base includes a graduated scale for use in adjustably aligning the end plates on the guide.

4 Claims, 5 Drawing Sheets

SKATEBOARD AXLE MOUNTING APPARATUS

FIELD OF THE INVENTION

This invention relates to a skateboard axle mounting apparatus. More particularly, this invention pertains to an apparatus for mounting a friction-reducing accessory, such as a snow ski, ice-runner or a roller/belt assembly to a conventional skateboard truck.

BACKGROUND OF THE INVENTION

Several devices are known in the prior art for adapting skateboards for use with slidable accessories, such as snow skis. For example, U.S. Pat. No. 4,161,323 granted to Wetteland on July 17, 1979 discloses a snow ski apparatus that can be removably attached to a standard skateboard truck. The apparatus includes a fore-ski and a rear-ski section which may be connected respectively to the front axle and the rear axle of a skateboard. The ski sections of the resulting ski board can be manipulated by the user in substantially the same manner as the rollers of an ordinary roller skateboard.

European patent No. 0,063,179 dated Oct. 27, 1982 reveals a skateboard having four separate skis or runners attachable to standard skateboard axles. U.S. Pat. No. 4,225,145 granted to Carr on Sept. 30, 1980 discloses a modified skateboard having ski runners attachable to the pivotable truck of a conventional skateboard. U.S. Pat. No. 4,138,128 and French patent Nos. 2405-722, 2420-984 and 2423-243 also disclose various apparatuses for attaching slidable ski runners and the like to a standard skateboard frame.

The above-noted references have several apparent disadvantages or shortcomings. Most of the prior devices require extensive customized installation. Thus, once installed, these devices can be used only for a relatively limited function, such as snow skiing, and only with that particular skateboard.

In recent years skateboards of varying axle length have become available which are designed for specific purposes, such as slalom racing or trick skateboarding. However, several of the existing devices which the inventor is aware of are designed for use only with skateboard axles of a predetermined axle length. This greatly limits the adaptability of such devices.

SUMMARY OF THE INVENTION

The subject invention allows the user to easily interchange various accessories by attaching them in a standard manner to a conventional skateboard truck. For example, a skateboard can be easily adapted for use on various terrains such as snow, ice, dirt and grass-covered slopes. The present invention incorporates an adjustable skateboard mounting mechanism which is designed to accommodate axles of variable length and which is constructed to better withstand lateral stress than prior devices.

In accordance with the invention, a skateboard axle mounting apparatus is provided having a base, a support element attached to the base for securely receiving a skateboard axle, and a mounting bracket for attaching the base to a friction-reducing accessory, such as a snow ski or a roller/belt assembly.

The support element preferably includes a guide located on the base and a pair of vertical end plates adapted to slidably cooperate with the guide. In one embodiment the guide is an elongate block which mates with corresponding slots in the vertical end plates. In alternative embodiments the guide may comprise a slot or a groove in the base which cooperates with a fastener or mating protrusion extending downwardly from the end plates.

The end plates preferably have bore holes for receiving the skateboard axle. Advantageously, the bore holes may be fitted with sealed roller bearings.

The support element may further incorporate an anchor block mounted on the guide for supporting the pivotable truck of a conventional skateboard. An anchor stud may also be provided for securing the anchor block to each of the vertical end plates when the axle mounting apparatus is assembled. Fasteners are provided for adjustably fastening the skateboard axle and the anchor stud to the end plates.

Preferably the base also includes a graduated scale for adjustably aligning the end plates at the appropriate position on the guide.

BRIEF DESCRIPTION OF THE DRAWINGS

In drawings which illustrate embodiments of the invention.

DETAILED DESCRIPTION OF THE PREFERRED EMBODIMENT

Figure 1:
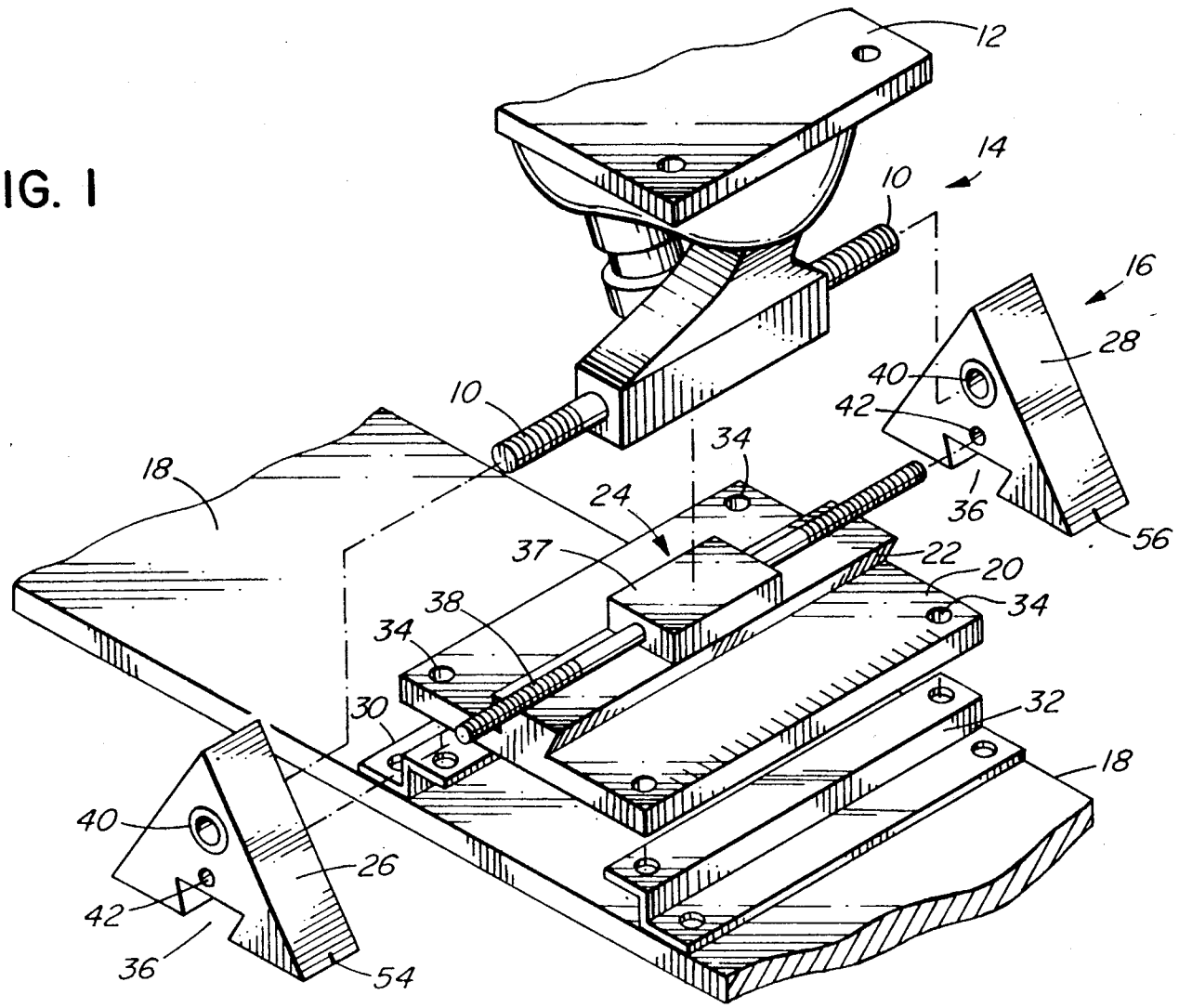
FIG. 1 is a partially exploded, perspective view of the skateboard axle mounting apparatus in conjunction with a conventional skateboard truck and a section of a snow ski.

With reference to FIG. 1, the front end of a standard skateboard is shown with its forward pair of roller wheels removed. Skateboard axle 10 is attached to platform 12 by means of pivotable truck 14. Truck 14 is designed to cause the skateboard to turn to one side or the other when pressure is applied unevenly to the wheels, or other mounted accessories, thus allowing the user to steer the board by leaning his weight to one side or the other.

The present invention is directed to a skateboard axle mounting apparatus generally designated 16 for attaching skateboard truck 14 to a friction-reducing assembly, such as a snow ski 18. Axle mounting apparatus 16 includes a base 20, a guide means 22 attached to base 20, an anchor means 24 attached to guide means 22 and a pair of vertical ends plates 26, 28 which may be adjustably secured to guide means 22 and anchor means 24 as discussed below.

As shown in FIG. 1, axle mounting apparatus 16 may also include a pair of mounting brackets 30 and 32 for securing base 20 to snow ski 18 or the like. Alternatively, base 20 may be mounted on snow ski 18 directly. Base 20 is a solid plate having a plurality of bore holes 34 for use in attaching base 20 to underlying brackets 30, 32 or directly to ski 18. Although base 20 is depicted as being rectangular in the drawings, it may be of any suitable shape and dimension.

Figure 2:
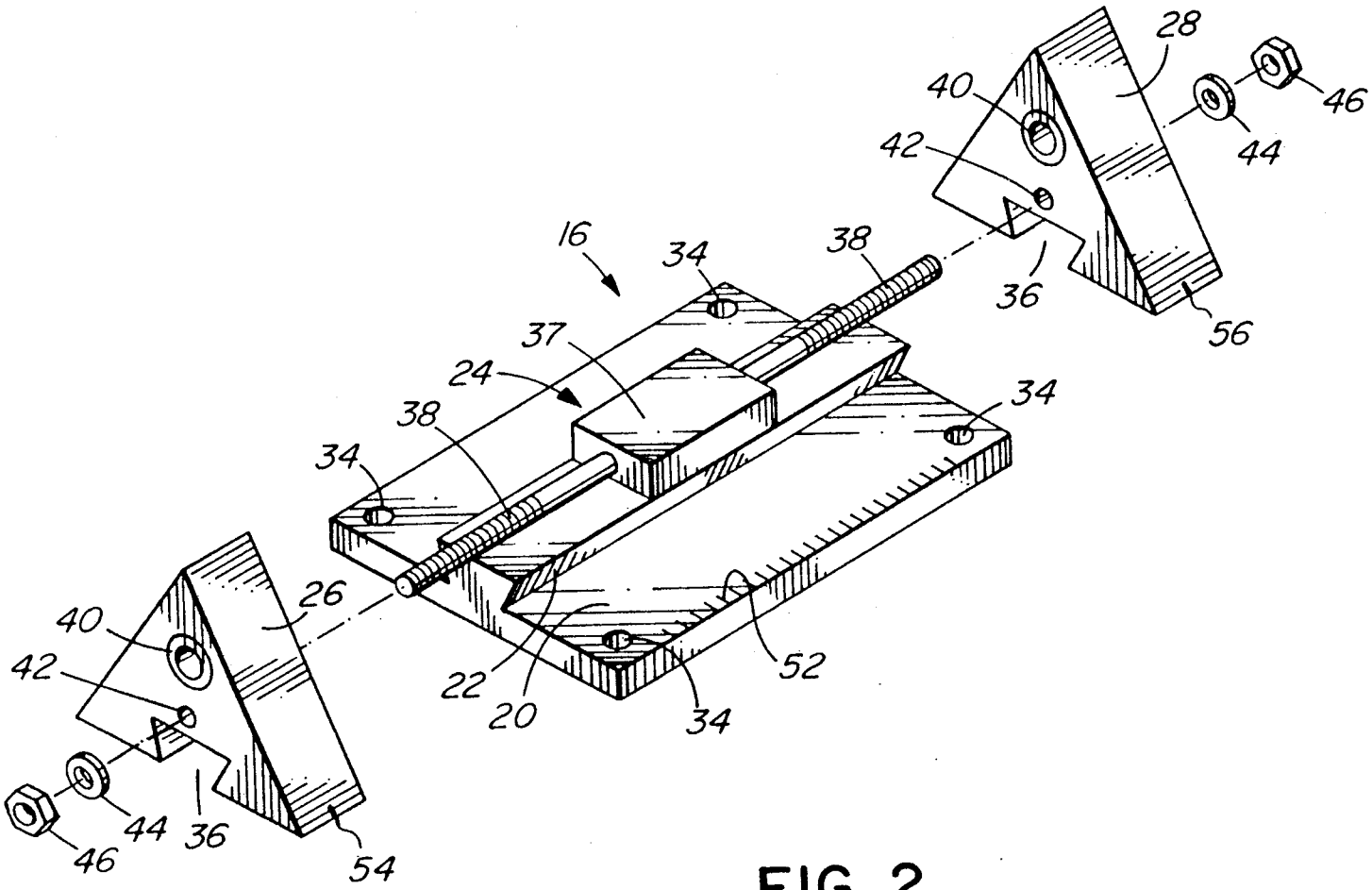
FIG. 2 is a partially exploded, perspective view of the skateboard axle mounting apparatus of FIG. 1.

Guide means 22 is preferably secured to the upper surface of base 20 along its lateral axis. As shown in FIGS. 1 and 2, guide means 22 may be an elongate, dovetail-shaped block which is designed to articulate with mating slots 36 in vertical end plates 26, 28. Guide means 22 thereby restricts vertical and longitudinal movement of end plates 26, 28 after they have been slidably fitted onto guide means 22. In other embodiments, guide means 22 may be T-shaped, cylindrical or some other geometric shape which can articulate with end plates 26, 28 in a similar manner.

Figure 3:
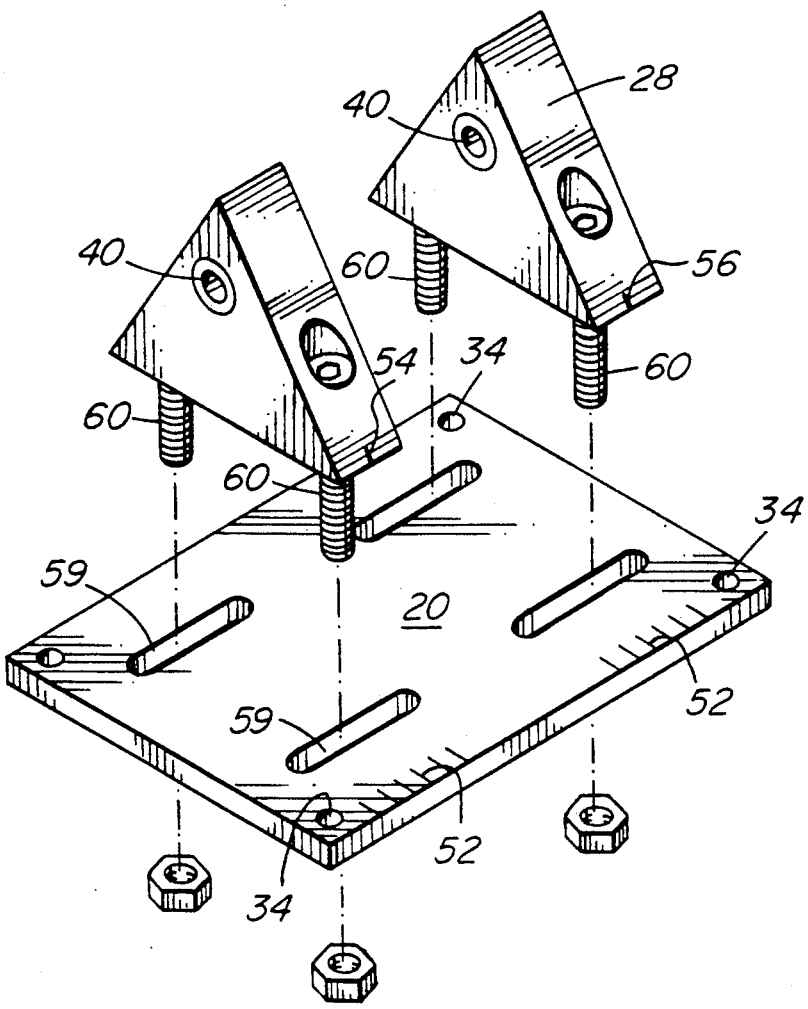
FIG. 3 is a partially exploded, perspective view of an alternative embodiment of the skateboard mounting apparatus which incorporates a slotted guide means.

In the embodiment shown in FIG. 3, guide means 22 may comprise one or more slots 59 located on base 20. Slots 59 are designed to receive fasteners 60 which extend downwardly from end plates 26, 28. Alternatively, guide means 22 may comprise one or more notched grooves on base 20 for mating with corresponding protrusions projecting downwardly from end plates 26, 28.

Anchor means 24 is secured to the upper, middle surface of guide means 22. As shown in FIGS. 1 and 2, anchor means 24 includes a solid anchor block 24 attachable to guide means 22 and a threaded anchor stud 38 extending outwardly from either side of anchor block 24 along the lateral axis of base 20.

End plates 26, 28 are preferably solid plates having bore holes 40 and 42 therethrough for receiving skateboard axle 10 and anchor stud 38 respectively. Bore holes 40 are fitted with sealed roller bearings to permit free rotation of axle 10 in end plates 26, 28. In the embodiment shown in FIGS. 1 and 2, end plates 26, 28 also include slots 36 for slidably mating with guide means 22 as discussed above.

Figure 4:
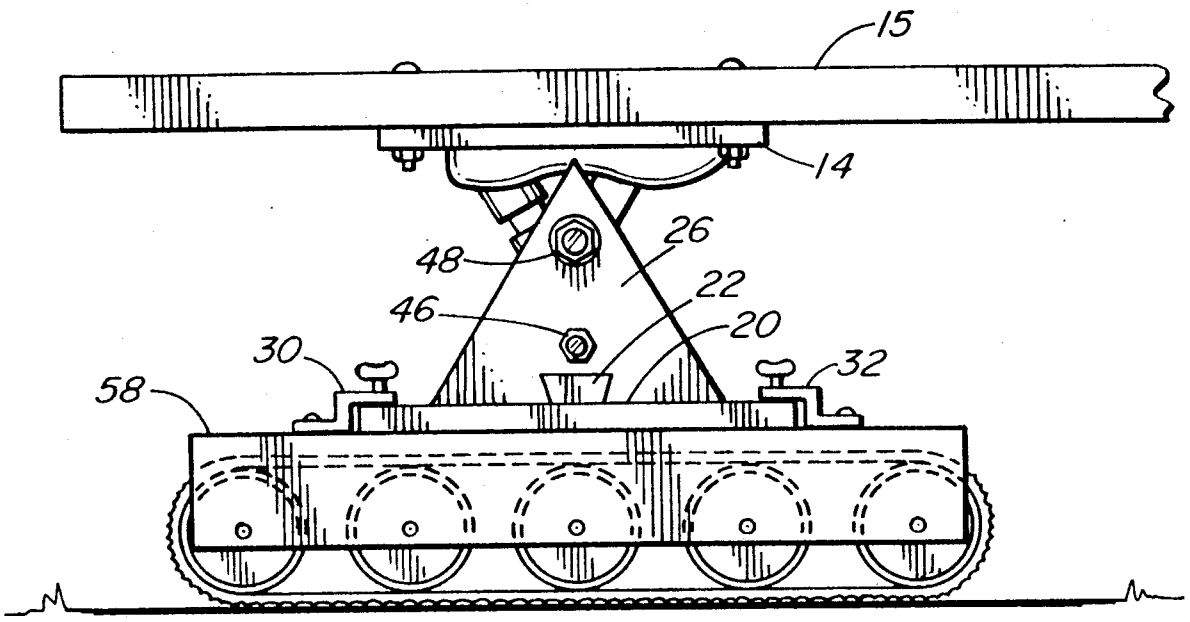
FIG. 4 is a side elevation view of the skateboard axle mounting apparatus assembled to attach a roller/belt assembly to a conventional skateboard frame.
Figure 5:
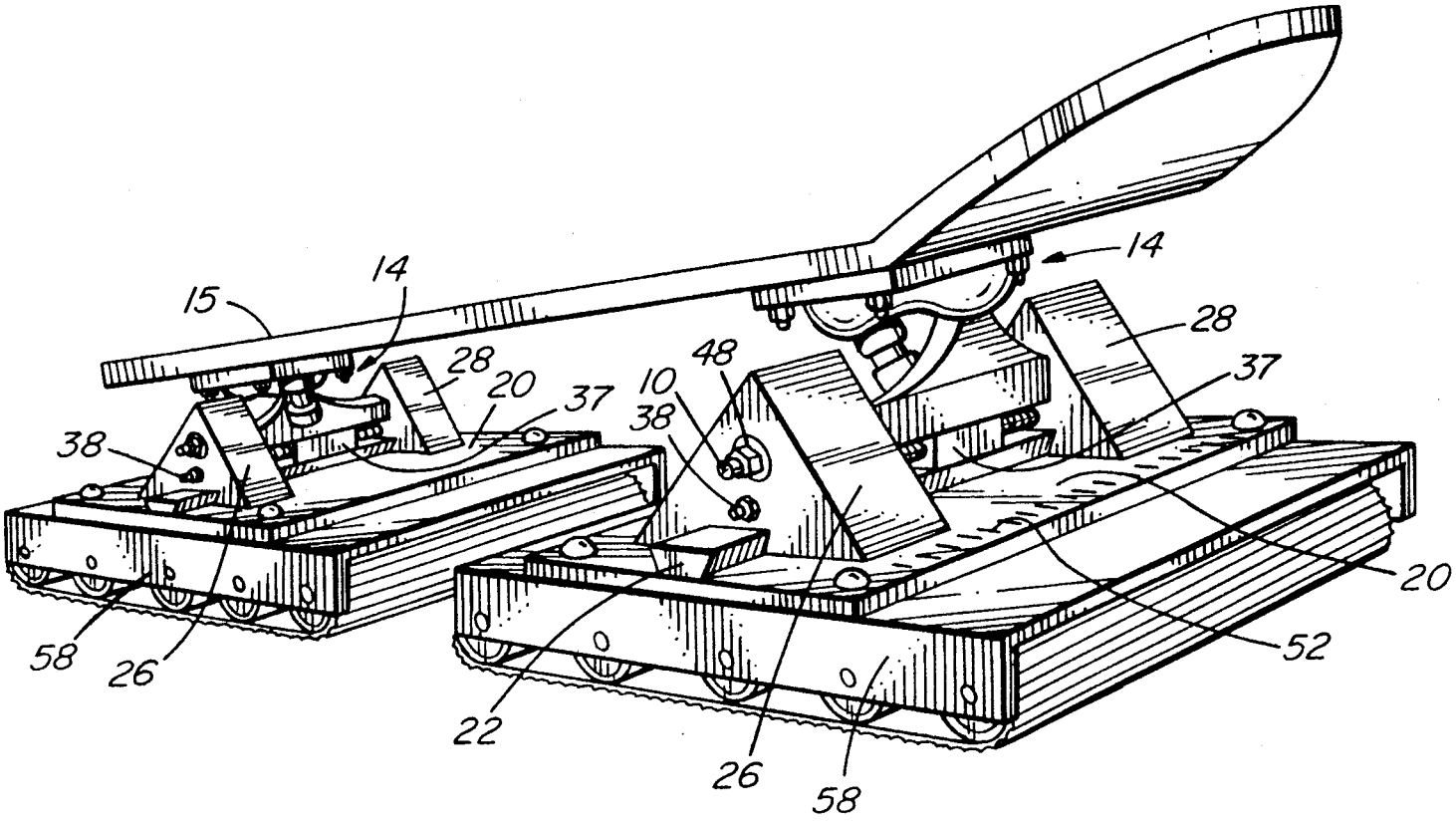
FIG. 5 is a perspective view of the skateboard axle mounting apparatus assembled to attach a roller/belt assembly to a conventional skateboard frame.

As shown in FIG. 2, anchor stud 38 may be maintained in bore hole 42 of end plates 26, 28 by means of lock washers 44 and nuts 46. Similarly, as shown in FIGS. 4 and 5, skateboard axle 10 may be maintained in bore hole 40 of end plates 26, 28 by axle nuts 48 which conventionally fasten the roller wheels of the skateboard to axle 10.

Base 20 includes a graduated scale 52 for use in aligning end plates 26, 28 on guide means 22. End plates 26, 28 include alignment markings 54, 56 to enable accurate alignment on graduated scale 52. Thus each end plate 26, 28 may be accurately off-set relative to skateboard platform 15 to suit the preference of the user.

In use, mounting brackets 30, 32 are attached at the desired location on a friction-reducing accessory, such as snow ski 18. Base 20 is then secured to mounting brackets 30, 32 such as by inserting suitable fasteners through bore holes 34 in base 20.

The skateboard is prepared for attachment to axle mounting apparatus 16 by removing the roller wheels from skateboard axle 10. As shown in FIG. 1, truck 14 is placed above the upper surface of anchor block 24. End plates 26 and 28 are then slidably fitted on to guide means 22; axle 10 and anchor stud 38 are concurrently inserted into bore holes 40 and 42 respectively. Graduated scale 52 and alignment markings 54, 56 may be used to align end plates 26 and 28 at the desired location on guide means 22. Nuts 46 and 48 can then be tightened to rigidly secure end plates 26 and 28 to anchor stud 38 and axle 10 respectively, thereby providing lateral support for axle mounting apparatus 16.

The rear skateboard axle is similarly attached to ski 18 to complete the mounting operation.

Once skateboard axle mounting apparatus 16 is assembled as aforesaid, the skateboard can then be manipulated by the user for its intended purpose, such as snow skiing. The design of apparatus 16 permits skateboard truck 14 to pivot fully so that the assembled apparatus may be readily steered in the same manner as a conventional roller skateboard. Since apparatus 16 is capable of withstanding a high degree of lateral stress when properly assembled, it provides the user with greater stability and maneuverability than prior devices.

Axle mounting apparatus 16 is also very versatile. It may be readily detached from snow ski 18 and used with other friction-reducing accessories, such as ice-runners or roller/belt assemblies. Moreover, apparatus 16 may also be conveniently used with other skateboard frames of variable axle length.

FIG. 4 shows the present invention in use with a conventional skateboard frame (including axle 10, platform 15 and truck 14) and roller/belt assembly 58. Roller/belt assembly 58 permits the skateboard to be used on uneven terrain such as dirt or grass-covered slopes. FIG. 5 shows a perspective view of the present invention in use with a skateboard frame and a pair of roller/belt assemblies 58.

The present invention may be adapted for a wide variety of similar uses. As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

The embodiments of the invention in which an exclusive property or privilege is claimed are defined as follows:

1. A skateboard axle mounting apparatus for attaching a ground engaging accessory to a skateboard axle comprising:

a planar base plate;

a guide block extending transversely across the width of said base plate, said guide block having an upper surface, a lower surface, and diverging walls extending from said lower surface to said upper surface, thereby providing said guide block with a dovetail-shaped cross-section, the lower surface of said guide block being secured to an upper surface of said base plate;

an anchor block attached to the upper surface of said guide block, said anchor block having an anchor stud extending transversely from opposite sides thereof;

a pair of vertical end plates, each end plate having an upper bore hole adapted to receive a respective end of said skateboard axle, a lower bore hole adapted to receive a respective end of said anchor stud, and a dove-tail shaped slot adapted to slidably receive a respective end of said guide block;

fastener means for releasably securing each end plate to a respective end of said skateboard axle and said anchor stud; and mounting means for releasably securing a ground engaging accessory to said base plate.

2. The skateboard axle mounting apparatus as defined in claim 1, wherein said upper bore holes are fitted with sealed roller bearings.

3. The skateboard axle mounting apparatus of claim 1, wherein said mounting means comprises a pair of universal brackets for use in attaching said base plate to said ground engaging accessory.

4. The skateboard axle mounting apparatus of claim 1, further comprising a graduated scale on said base plate for use in aligning said end plates along said guide means.

* * * * *